US008926366B2

(12) United States Patent
Dang

(10) Patent No.: US 8,926,366 B2
(45) Date of Patent: Jan. 6, 2015

(54) PCB-MOUNT ELECTRICAL CONNECTOR WITH SHIELDING FOR INHIBITING CROSSTALK

(71) Applicant: Phong Dang, Auburn, WA (US)

(72) Inventor: Phong Dang, Auburn, WA (US)

(73) Assignee: Carlisle Interconnect Technologies, Inc., Kent, WA (US)

( * ) Notice: Subject to any disclaimer, the term of this patent is extended or adjusted under 35 U.S.C. 154(b) by 85 days.

(21) Appl. No.: 13/851,079

(22) Filed: Mar. 26, 2013

(65) Prior Publication Data

US 2013/0252465 A1 Sep. 26, 2013

Related U.S. Application Data

(60) Provisional application No. 61/615,866, filed on Mar. 26, 2012.

(51) Int. Cl.
*H01R 13/648* (2006.01)
*H01R 13/6585* (2011.01)
*H01R 13/6589* (2011.01)

(52) U.S. Cl.
CPC ..... *H01R 13/6585* (2013.01); *H01R 13/6589* (2013.01)
USPC ..... 439/607.05

(58) Field of Classification Search
CPC ..... H01R 13/6585; H01R 13/6589
USPC ..... 439/607.05, 79
See application file for complete search history.

(56) References Cited

U.S. PATENT DOCUMENTS

| | | | | |
|---|---|---|---|---|
| 6,077,122 | A | 6/2000 | Elkhatib et al. | |
| 6,328,601 | B1 | 12/2001 | Yip et al. | |
| 7,195,518 | B2 | 3/2007 | Bert et al. | |
| 7,316,584 | B2 | 1/2008 | Mackillop et al. | |
| 7,736,159 | B1 | 6/2010 | Effinger, III et al. | |
| 8,591,268 | B2 * | 11/2013 | Reimchen | 439/701 |
| 2012/0171884 | A1 | 7/2012 | Dang | |

FOREIGN PATENT DOCUMENTS

| | | | |
|---|---|---|---|
| EP | 2 355 258 | A1 | 2/2011 |
| FR | 2 805 932 | A1 | 3/2000 |
| WO | WO 2010/115514 | A2 | 10/2010 |

OTHER PUBLICATIONS

International Electrotechnical Commission, Publicly Available Specification IEC/PAS 61076-2-109 (Pre-Standard), Edition 1.0, dated Mar. 2010, 8 pages.
Yoshitake, James, Interconnect Solutions for Aircraft Ethernet Data Networks, Defense Electronics Magazine, Oct. 2007, pp. 14-17, Penton Media, Inc.
Phoenix Contact, Assembly Instructions, VS-08-M12MS-10G-P SCO and VS-08-M12MR-10G-P SCO, dated Mar. 2010, 1 page.

* cited by examiner

*Primary Examiner* — Javaid Nasri
(74) *Attorney, Agent, or Firm* — Stoel Rives LLP

(57) ABSTRACT

A board-mount electrical connector includes an electrically conductive rear shell interposed between a contact-retaining front body and an insulator member that holds a plurality of board-mount contacts. The rear shell includes at least one electrically conductive shielding divider that extends through the insulator member and is positioned between two or more of the board-mount contacts. Also disclosed is a rear shell elbow for an electrical connector that is assembled from a pair of slidably interlocking members that form an X-shaped divider within the rear shell when assembled.

15 Claims, 5 Drawing Sheets

PCB-MOUNT ELECTRICAL CONNECTOR WITH SHIELDING FOR INHIBITING CROSSTALK

RELATED APPLICATION

This application claims the benefit under 35 U.S.C. §119 (e) from U.S. Provisional Patent Application No. 61/615,866, filed Mar. 26, 2012, which is incorporated herein by reference.

TECHNICAL FIELD

The field of this disclosure relates to electrical connectors and, in particular, to board-mount connectors including shielding features for reducing interference and crosstalk amongst different conductors within the connector and/or at the electrical interconnection between the conductors and the printed circuit board.

BACKGROUND

Increasingly, electronic devices transmit and receive high-frequency electrical signals representing digital data. High-speed data transmission, such as so-called Ultra High-Speed (UHS) data transmission involves the transmission of data between electronic devices at rates of 1 to 10 gigabits per second using signal frequencies of 100 MHz to 500 MHz. There is a desire for future high-speed data transmission at even faster rates and at even higher frequencies. High-speed digital data transmission is facilitated by a data transmission system with a relatively high signal to noise ratio. One exemplary system includes a 1000BASE-T Ethernet network that includes category 5, 5E, 6 or 6A cables. Cables in such a system are designed to propagate data signals without exhibiting, inducing, generating or introducing appreciable noise in the data signals, and are terminated by electrical connectors at either end to either connect cables together, or to connect cables to electronic devices.

One wire-terminating connector designed for UHS data transmission is described in U.S. patent application Ser. No. 13/314,174, filed Dec. 7, 2011, titled "Electrical Connector for High-Speed Data Transmission" ("the '174 application"), which is assigned to the assignee of the present invention. Wire-terminating connectors such as those described in the '174 application do not address certain challenges associated with connectors of the kind that mount directly to a printed circuit board (PCB). Such board-mount (or PCB-mount) connectors serve as a connection point for coupling a wire-mount connector, or in some cases another board-mounted connector, to form a system of electrical interconnection between devices.

PCB-mount connectors are typically electrically connected to contact locations on the PCB via soldered or solderless unshielded contacts spaced closely together, which leaves the connector susceptible to crosstalk. Thus, a need remains for a board-mount connector with improved shielding features for reducing crosstalk, noise, and interference in high-speed data transmission systems, including shielding for adjacent conductors or pairs of conductors within the connector and at the PCB interface.

Some engineering applications require an angled PCB-mount connector mounted to a PCB along a first termination axis that is angled relative an interconnection coupling axis between the PCB-mount connector and a mating connector. Angled connectors include right-angle connectors, 45-degree connectors, and connectors of other various angles between the termination axis and the interconnection coupling axis. The present inventors have recognized that angled PCB-mount connectors present particular challenges for shielding adjacent conductors or pairs of conductors of the connector and at their interconnection to the PCB. A need therefore also remains for improved shielding in an angled board-mount connector.

DETAILED DESCRIPTION OF PREFERRED EMBODIMENTS

Figure 1:
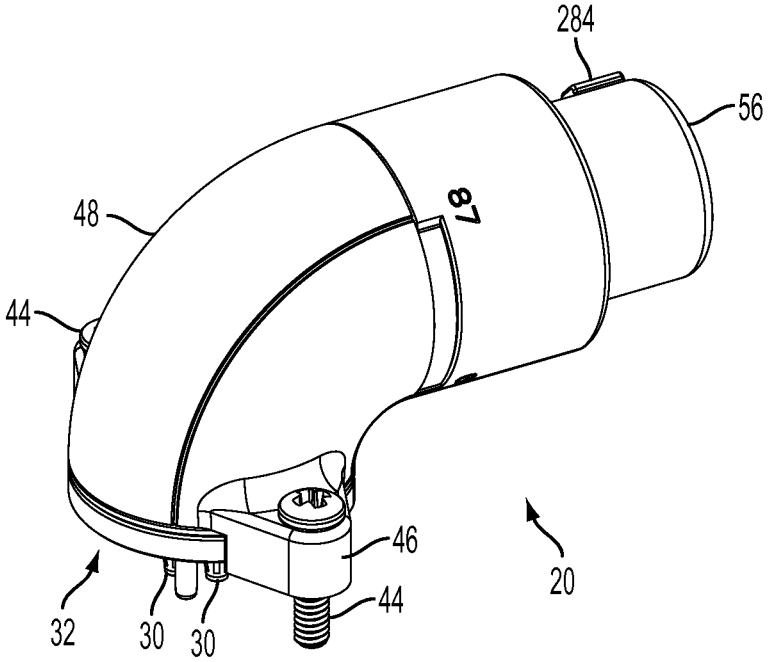
FIG. 1 is an isometric view of a right-angle PCB-mount electrical connector according to an embodiment.
Figure 2:
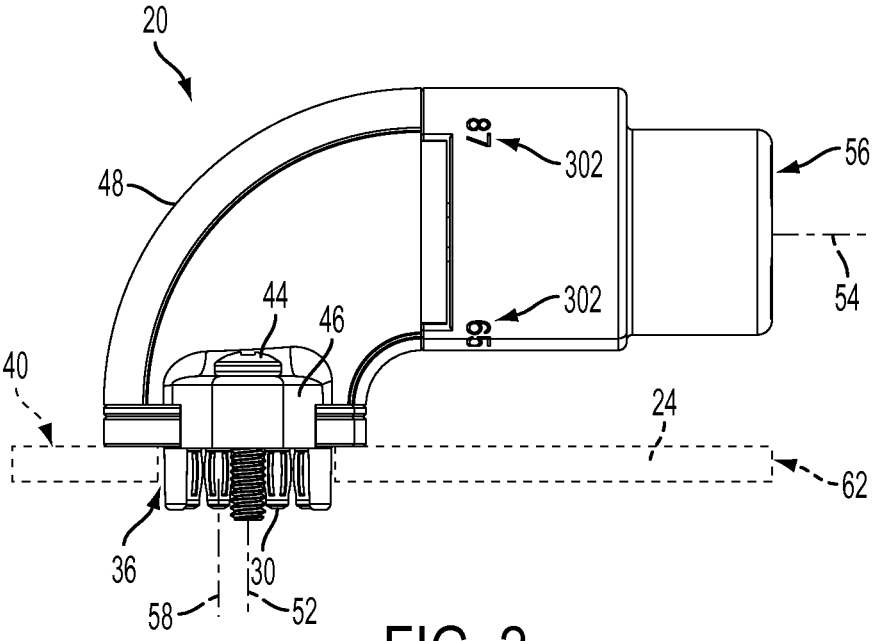
FIG. 2 is a side elevation view of the connector of FIG. 1 shown mounted to a PCB, which is illustrated schematically in dashed lines.

With reference to FIGS. 1 and 2, a board-mount electrical connector 20 according to a embodiment is mountable to a printed circuit board (PCB) 24 (FIG. 2) to provide electrical interconnection to contact locations on PCB 24. In the illustrated embodiment, connector 20 includes solderless press-fit pin contacts 30 (board-mount contacts) at a rear end 32 of connector 20 which are inserted into through a corresponding set of contact through-holes 36 in PCB 24. Through-holes 36 will typically have conductive inner circumferential surfaces for making electrical contact with board-mount contacts 30. In other embodiments, board-mount contacts 30 may be through-hole pin contacts which are soldered to PCB 24 or surface-mount contacts that engage conductive lands or pads (not illustrated) on the face 40 of PCB 24, such as solder type surface-mount contacts or spring-loaded pogo pin solderless contacts. A pair of screws 44 or other fasteners extend through mounting flanges 46 of connector 20 and into mounting holes in PCB 24 to securely retain connector 20 to PCB 24.

Connector 20 illustrated in FIGS. 1-2 is right-angle style including an elbow bend 48 forming a 90-degree angle between a mounting axis 52 of connector 20 and a coupling axis 54 along which a mating connector is moved for coupling to a mating end 56 of connector 20. In the illustrated embodiment, mounting axis 52 is aligned with the insertion axes 58 of through-hole contacts 30, which are generally perpendicular to face 40 of PCB 24 when mounted. In other embodiments, connector 20 may be a straight connector, in which the mounting axis and coupling axis are aligned, or may be an angled connector having an angle other than 90-degrees, such as 45 degrees, 30 degrees, or some other angle relative to a direction normal to the face of PCB.

One suitable mating connector is a wire-terminating pin connector of the kind described in U.S. patent application Ser.

No. 13/314,174, filed Dec. 7, 2011 ("the '174 application"), which is incorporated herein by reference. A commercially available version of such a mating connector is sold under the trademark OCTAX™ by Carlisle Interconnect Technologies of Tukwila, Wash. and St. Augustine, Fla., USA.

Figure 3:
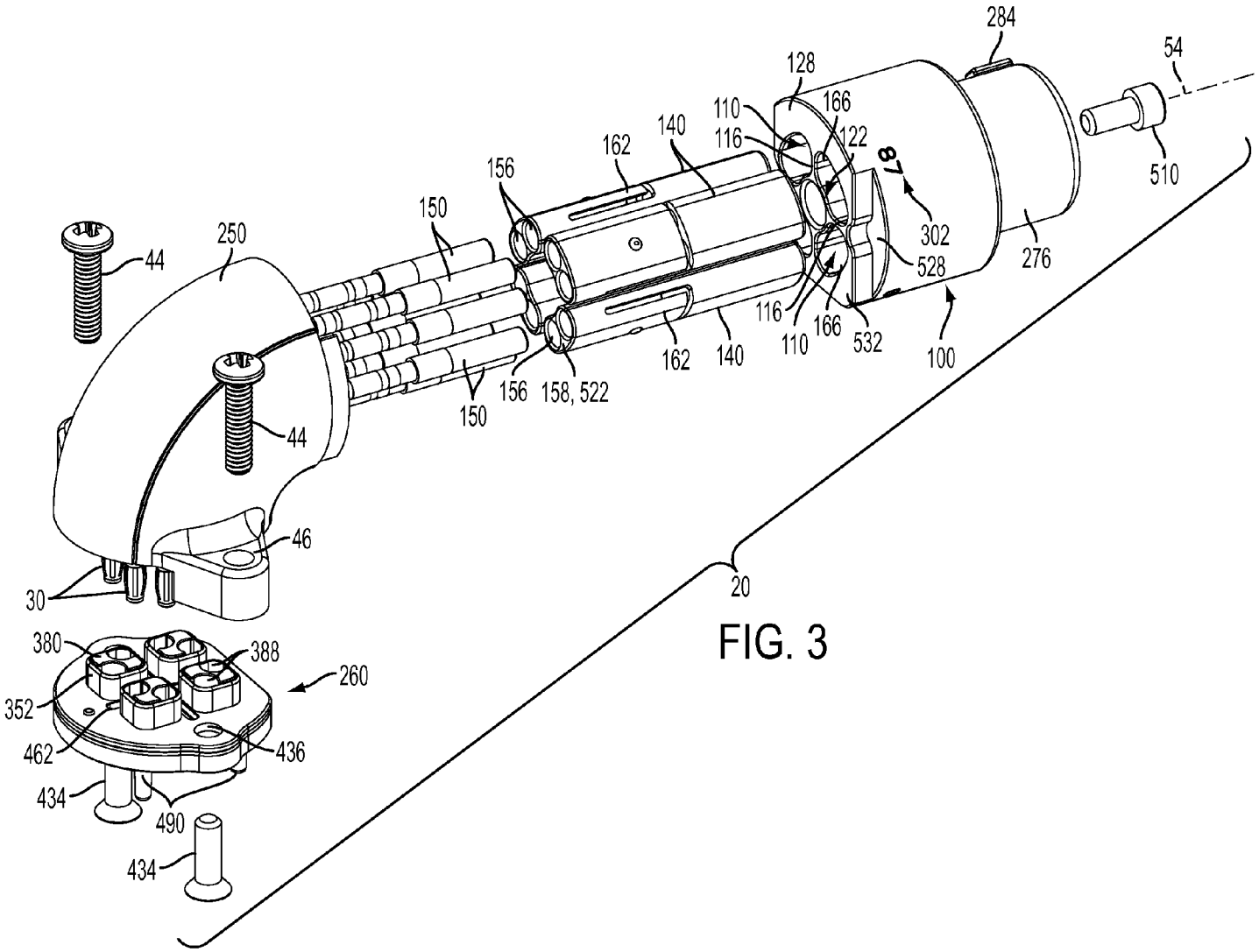
FIG. 3 is a partially exploded view of the connector of FIGS. 1-2.

FIG. 3 is a partially exploded view of connector 20. With reference to FIG. 3, connector 20 includes a conductive front body 100 (front shell) defining four cavities 110 extending in an axial direction along the insertion axis 58 entirely through front body 100. Cavities 110 are separated by four conductive fins 116 radiating from a conductive central core 122 and integrally interconnecting the central core 122 to a conductive peripheral barrel section 128 of front body 100. Four insulating sheaths 140 are provided, each of which receives and carries a pair of socket contacts 150 in spaced-apart relation. Each of the contacts 150 is inserted into one of a pair of rear apertures 156 at the rear face 158 of a corresponding one of the sheaths 140, and seated and retained in sheath 140 by a cantilevered latch 162, as further described in the '174 application. Each sheath 140 is inserted into one of the cavities 110 via a rear opening 166 thereof, as further described in the '174 application. When assembled, the pair of contacts 150 held by sheath 140 are positioned in alignment with the insertion axis 58.

Figure 4:
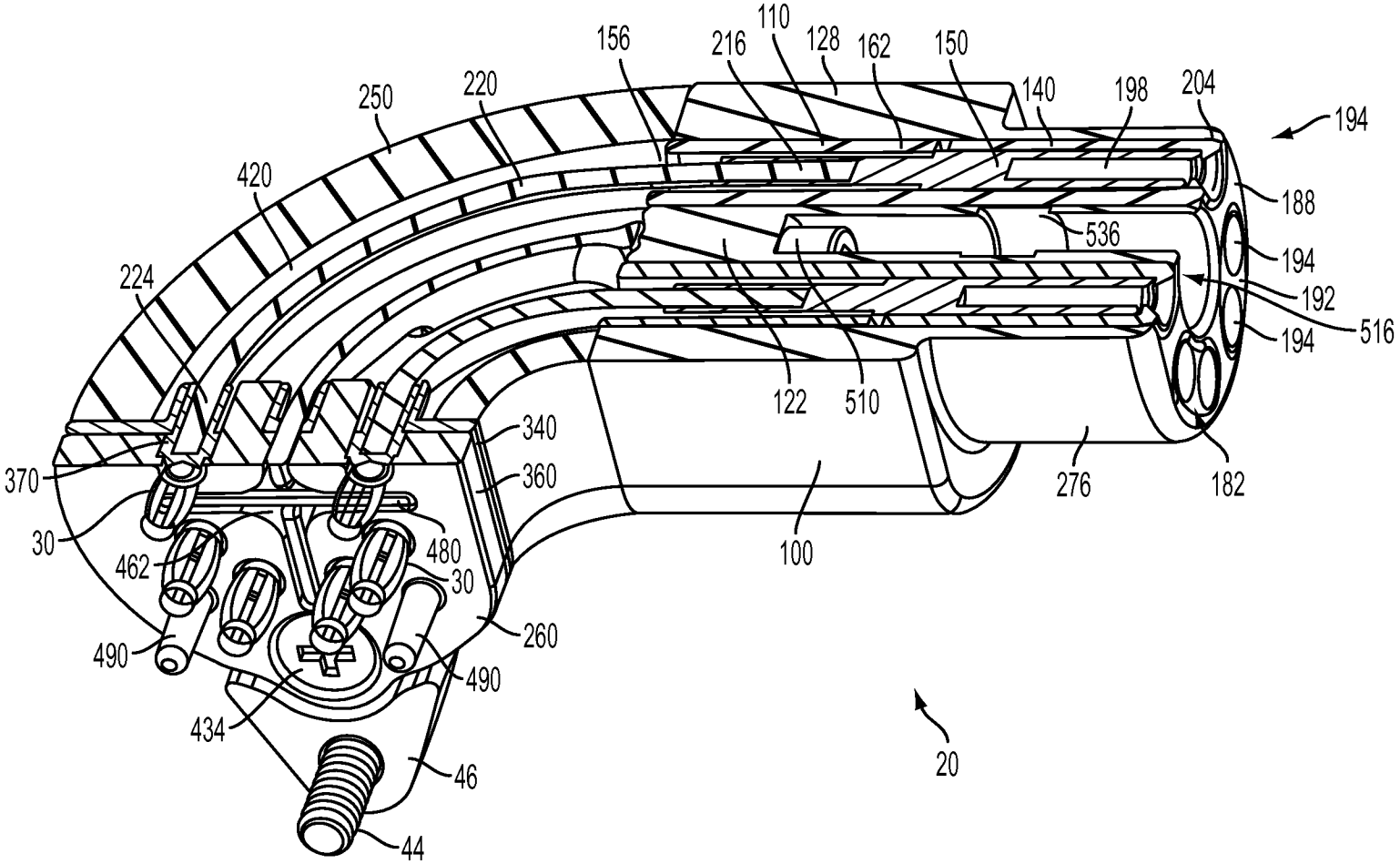
FIG. 4 is an isometric section view of the connector of FIGS. 1-2.

FIG. 4 is an isometric section view illustrating the assembled connector 20, including the arrangement of front body 100, sheaths 140, and socket contacts 150. Socket contacts 150 are held by insulating sheaths 140 in alignment with front openings 182 of cavities 110 that extend through a front end 188 of front body 100. Insulating sheaths 140 are made from an insulating material, for example a molded high-temperature composite thermoplastic material such as polyetherimide resin (e.g., molded glass-reinforced polyetherimide resin), and prevent contacts 150 from contacting each other or any of the conductive surfaces of front body 100. A front face 192 of each sheath 140 includes a pair of front apertures 194 aligned with and providing access to a socket portion 198 of each of the contacts 150 retained in sheath 140. Front face 192 or a surrounding front edge of each sheath 140 seats against an internal lip 204 of front body 100 bordering front opening 182.

Figures 5, 6:
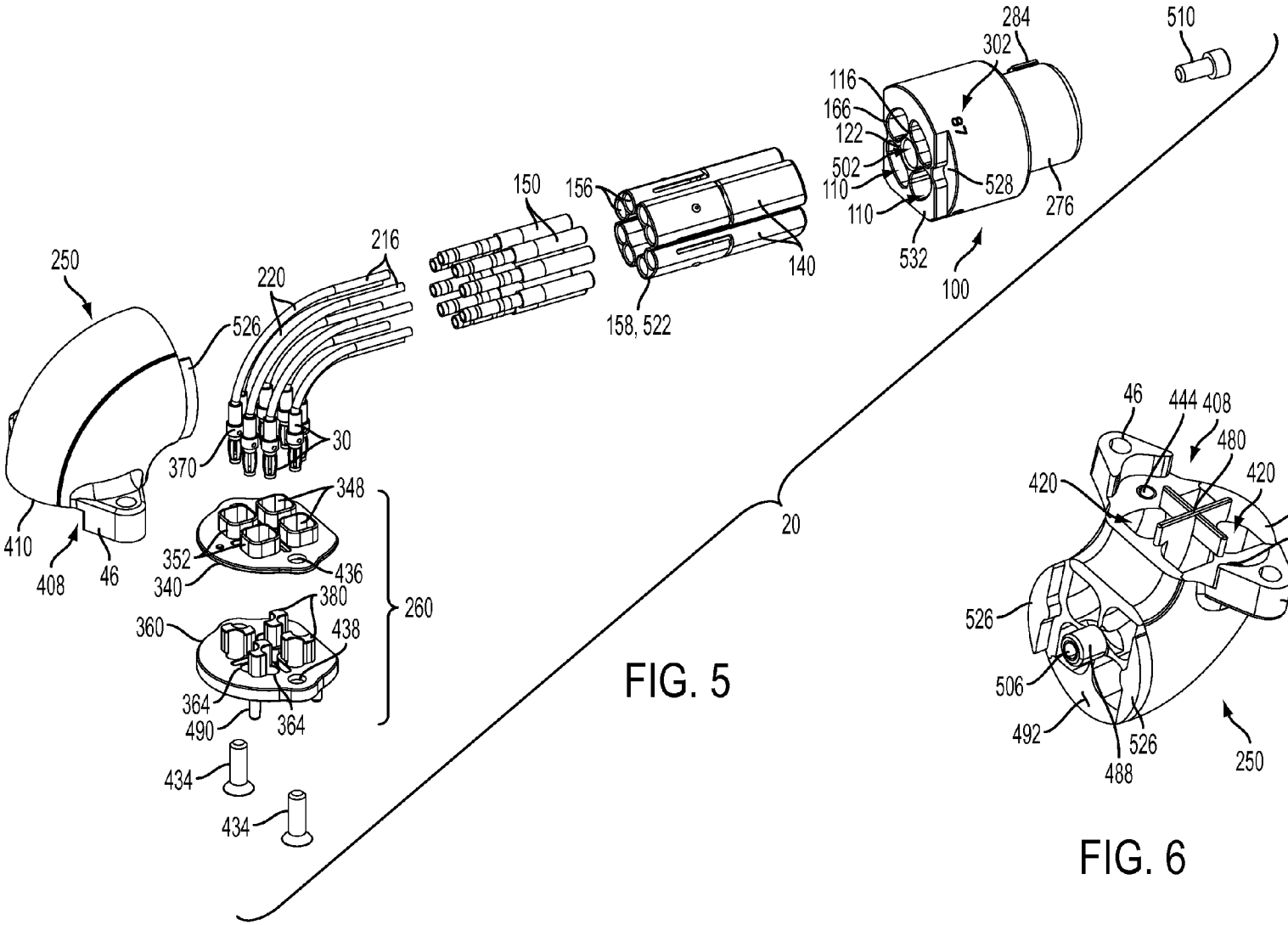
FIG. 5 is a further exploded assembly view of the connector of FIGS. 1-4 with mounting screws of the connector omitted.
FIG. 6 is a bottom isometric view of a two-piece rear shell component of the connector of FIGS. 1-5 forming a shielding elbow thereof.

FIG. 5 is a more fully exploded view of connector 20. With reference to FIGS. 4 and 5, each of the socket contacts 150 is attached, by crimping or otherwise, to a first end 216 of a segment of wire 220. In one embodiment, wires 220 are machine-bent segments copper wire that are gold plated and may have optional insulating sheaths added. In other embodiments, wire 220 includes insulated wire in which the insulation has been stripped from first end 216 prior to crimping. Each of the wires 220 extends through a conductive rear shell 250 of connector, further described below with reference to FIGS. 6-10. A second end 224 of each wire 220 is connected to a crimping end of one of the board-mount contacts 30. Board-mount contacts 30 are securely held in spaced-apart relation by a bottom insulator subassembly 260, as further described below. If machine-bent solid copper wires are used, then wires 220 may be maintained in a generally parallel relationship within rear shell 250. In other embodiments, such as when insulated wires are used, adjacent pairs of wires may be twisted pairs between the board-mount contacts 30 and the socket contacts 150 to further reduce crosstalk. For twisted pairs, insulated solid conductor wires (e.g. solid copper) are preferred to maintain control over twist rate/pitch, but multi-strand insulated wires may also be used.

Socket contacts 150 may preferably be a standard crimp contact of the kind often used in aerospace applications, such as 22 awg machined high-density socket contacts meeting US military specification MIL-C-39029 and commonly identified as Military Specification Part No. M39029/57-354. Although socket contacts 150 are utilized in the illustrated embodiment, connector 20 is considered a plug type connector because when connector 20 is mated with a mating connector, a front plug portion 276 of front body 100 seats within a cylindrical front shell portion of the mating socket type connector (which includes pin contacts). An orientation key 284 radially outward from front plug portion 276 and is sized to slidably mate with an orientation slot in the front shell of a mating connector to ensure the proper matching of conductors electrically coupled to the socket contacts 150 and pin contacts of the respective connectors. In an alternative embodiment, front body 100 may be formed in the shape of a socket body making connector 20 a socket connector. In other embodiments, contacts 150 may be pin contacts, another type of plug contact, or a type of contact other than a pin or socket contact, housed either in a plug body or socket body. Numbering indicia 302 (see also FIG. 2) around an outer surface of barrel section 128 of front body 110 indicate the positions of the eight contacts 150 of connector 20.

The central core 122, fins 166, and barrel section 128 of front body 100 are preferably all integrally formed in a monolithic structure to eliminate pathways for crosstalk or outside radio-frequency (RF) interference. Each of the fins 116 separates and shields adjacent ones of the cavities 110 from each other. Rear shell 250 includes similar shielding features in a monolithic construction or a two-piece interlocking assembly described below with reference to FIGS. 6-10. Front body 100 and rear shell 250 are both preferably made from an electrically conductive material or a non-conductive material with a conductive coating or plating, such as aluminum alloy with electroless nickel plating, for example. Other suitable materials, such as gold or silver, can be used to plate front body 100, and other suitable materials, such as steel, copper or other suitable electrically conductive material, can be used to form front body 100. In other embodiments, front body 100 is made from an insulating material, such as molded polyetherimide or other suitable plastic resin, and is coated or plated with an electrically conductive material, such as silver, gold, or nickel. In a preferred embodiment, front body 100 is machined from a single unitary block of metal, but other methods of integrally forming front body 100 in a monolithic structure include molding, casting, and metal injection molding (MIM), for example.

Continuing with reference to FIGS. 4 and 5, bottom insulator subassembly 260 includes an inner insulator plate 340 having four oblong openings 348, each bordered by an inwardly depending skirt 352 and sized to accommodate a portion of a pair of the board-mount contacts 30, and an outer insulator plate 360. Outer insulator plate 360 includes four pairs of contact apertures 364 each pair aligned with one of the oblong openings 348 of inner insulator plate. Each contact aperture 364 is sized to allow a board end of one of the contacts 30 to pass therethrough. Oblong openings 348 and contact apertures 364 each include a small lip extending therearound which captures a shoulder portion 370 of contact 30 between insulator plates 340, 360 and prevents contact 30 from moving relative to insulator subassembly 260. Outer insulator plate 360 includes four hourglass-shaped pillars 380 projecting from an inwardly-facing surface of outer insulator plate 360 and extending into oblong openings 348 within skirts 352 to divide oblong openings 348 into two generally cylindrical electrically isolated contact-receiving spaces 388 (FIG. 3). Pillars 380 cooperate with skirts 352 to provide mechanical support for contacts 30 and to inhibit adjacent contacts 30 from touching each other.

FIG. 6 is a bottom view of rear shell 250. With reference to FIGS. 3-6 and particular reference to FIGS. 5 and 6, insulator subassembly 260, carrying contacts 30, is nested in a bottom recess 408 in a rear end 410 of rear shell 250 between mounting flanges 46 (mounting feet) such that each of the oblong openings 348 and its associated pair of contact apertures 364 align with one of four wire-isolating passageways 420 of rear shell 250. Two screws 434 (or pins or other fasteners) extend through mounting holes 436, 438 in lateral portions of respective inner and outer insulator plates 340, 360, and thread into threaded bores 444 (FIG. 6) in rear end 410 of rear shell 250 to secure insulator subassembly to rear shell 250. Co-aligned crossed slots (X-shaped slots) in insulator plates 340, 360 form an X-shaped slot 462 through insulator subassembly 260 providing clearance for a projecting portion of an X-shaped shielding divider 480 of rear shell 250 described in greater detail below with reference to FIGS. 6-10. Outer insulator plate 360 includes two or more alignment pins 490 projecting outwardly therefrom for assisting in alignment of connector 20 to PCB 24 during insertion of contacts 30 into through-holes 36 in PCB 24 and to facilitate securing connector 20 to PCB 24. Insulator plates 340, 360 are both made of an electrically insulating material, for example a molded high-temperature composite thermoplastic material such as polyetherimide resin.

In an alternative embodiment, insulator subassembly 260 may be replaced by an injected insulator formed by an insert molding process, wherein an insert part subassembly including the rear shell 250, wires 220 and crimp-connected contacts (board contacts 30 or socket contacts 150, or both) are inserted into a mold cavity that is shut off against the inserted parts, then plastic material is injected into the cavity to encapsulate a portion of the insert part subassembly. In an insert molding process, an insulating thermoplastic resin such as polyetherimide is injected into wire-isolating passageways 420 to encapsulate wires 220 and an inner portion of board contacts 30 to stabilize and secure them to rear shell 250 while electrically insulating between contacts 30. To facilitate insert molding, the insulation on wires 220 is preferably a temperature resistant material such as PTFE.

Turning again to FIG. 6, rear shell 250 includes a central post portion 488 (mounting boss) that extends from a front major face 492 of rear shell and into a rear counterbore 502 (FIG. 5) in front body 100, when connector 20 is assembled. A threaded bore 506 in central post portion 488 threadably receives a socket-head cap screw 510 which is inserted through a front counterbore 516 (FIG. 4) of front body 100 and tightened using a hex key to securely fasten and draw rear shell 250 and front body 100 together. A portion or edge of front major face 492 of rear shell 250 may abut a rear end 522 of sheaths 140 to urge sheaths 140 forwardly against lip 204 and/or retain sheaths 140 in cavities 110, as best illustrated in FIG. 3. Lateral tabs 526 extending forwardly from front major face 492 of rear shell extend into and seat in lateral notches 528 in left and right sides of front body 100 at a rear end 532 of front body 100 when connector is assembled 20. Lateral tabs 526 and notches 528 prevent rotation of rear shell 250 relative to front body, and may be positioned and dimensioned to mate with a light interference fit or tight slip fit so as to achieve good electrical grounding contact between front body 100 and rear shell 250 for improved shielding performance. An inner circumferential groove 536 is provided in front counterbore 516 (FIG. 4) to cooperate with a latching post portion of a mating connector for latching engagement between connectors and to ensure a good electrical grounding connection between front body 100 and a front shell portion of the mating connector.

Figure 9:
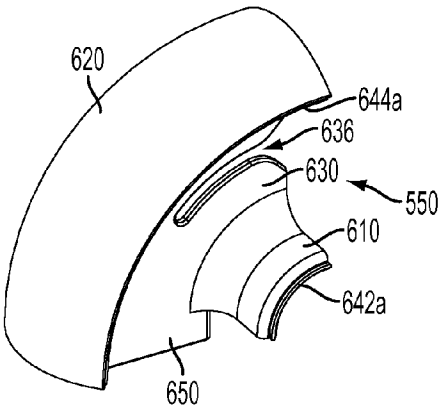
FIGS. 9 and 10 are respective top and bottom isometric views of a center elbow part which is shaped to slidably interlock with the lateral elbow part of FIGS. 7 and 8 to complete the rear shell of FIG. 6.
Figure 10:
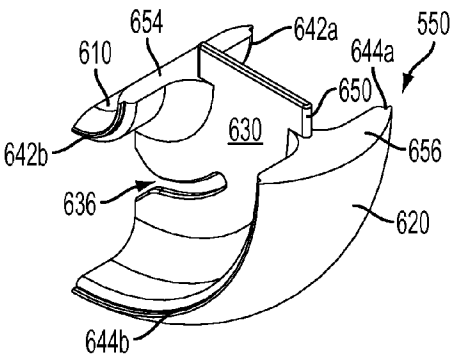
Figure 7:
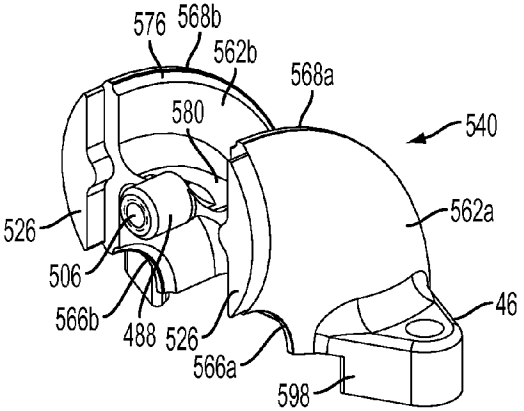
FIGS. 7 and 8 are respective top and bottom isometric views of a lateral elbow part of the rear shell of FIG. 6.
Figure 8:
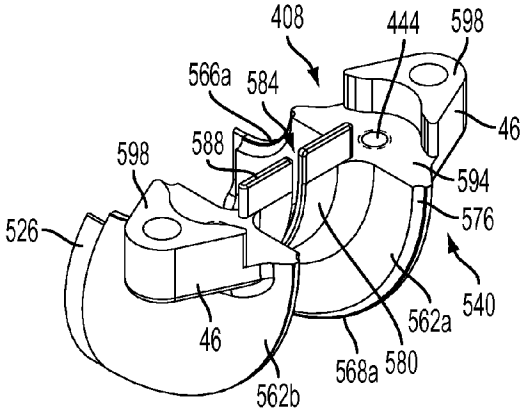

Rear shell 250 is assembled from a lateral elbow part 540 (lateral shell part), illustrated in FIGS. 7 and 8, and an interlocking center elbow part 550, illustrated in FIGS. 9 and 10. With reference to FIGS. 7 and 8, lateral elbow part 540 includes left and right side walls 562*a* and 562*b* having respective minor arcuate edges 566*a*, 566*b* and respective major arcuate edges 568*a*, 568*b* which are parallel to minor arcuate edges 566*a*, 566*b*, and together with minor arcuate edges 566*a*, 566*b* define a bend shape of side walls 562*a*, 562*b*. Side walls 562*a*, 562*b* are joined by a central web portion 580 extending between inner surfaces of side walls 562*a*, 562*b* medially of the major and minor arcuate edges, i.e. from medially of edges 566*a* and 568*a* to medially of edges 566*b* and 568*b* and along a curved surface parallel thereto. A first slot 584 extending generally parallel to major and minor arcuate edges 566*a*, 566*a*, 568*a*, 568*b* is formed along a rear half of web portion 580 proximate rear end 410 (FIG. 6). Arcuate edges 566*a*, 566*b*, 568*a*, 568*b* and slot 584 share a common axis of curvature. Arcuate edges 566*a*, 566*b*, 568*a*, and 568*b* are preferably coved (see cove surfaces 576) to facilitate sliding interlocking engagement with center elbow part 550. First and second lateral tab portions (blades) 586 and 588 of web portion 580 extend into recess 408 so that the height of tab portions 586, 588 beyond a recess surface 594 of lateral elbow part 540 is approximately the same as or somewhat greater or less than the height of feet portions 598 of flanges 46 beyond the recess surface 594. For example, feet portions 598 may extend beyond the distal ends of tab portions 586, 588 by a distance of approximately 0.001 to 0.015 inches and more preferably 0.001 to 0.005 to ensure positive contact is made between feet portions 598 and grounding pads on the face 40 of PCB 24. Screws 44 extend through mounting flanges 46 in rear shell 250 and are screwed into holes in PCB 24 adjacent such grounding pads to ensure that a positive grounding connection is made between the grounding pads and feet portions 598 and so that rear shell 250, front body 100 and shielding shell components of a mating connector are all grounded to provide effective shielding of conductors in the connector system.

Turning now to FIGS. 9 and 10, center shell part 550 includes spaced-apart curved front and rear walls 610 and 620, respectively, and a flat central web portion 630 extending therebetween. Web portion 630 includes an arcuate second slot 636 along a front half of web portion 630 and sized so that web portions 580 and 630 of respective lateral and center elbow parts 540, 550 can be slidably interlocked to form rear shell 250. Front wall 610 includes left and right minor arcuate edges 642*a*, 642*b* which include bead surfaces that slidingly mate against respective coved minor arcuate edges 566*a* and 566*b* of lateral elbow part. Similarly rear wall 620 includes left and right major arcuate edges 644*a*, 644*b* which include bead surfaces that slidingly mate against respective coved major arcuate edges 568*a* and 568*b* of lateral elbow part 540 when elbow parts 540, 550 are assembled to form rear shell 250. Arcuate edges 642*a*, 642*b*, 644*a*, 644*b*, and second slot 636 share a common axis of curvature. A blade extension 650 of web portion 630 projects beyond co-planar bottom surfaces 654 and 656 of respective front and rear walls 610, 620 by a distance equal to the distance that first and second lateral tab portions 586 and 588 of lateral elbow part 540 extend beyond recess surface 594 of lateral elbow part 540. When rear shell 250 is assembled, blade extension 650 crosses through first slot 584 and perpendicular to first and second tab portions 586, 588 to collectively with web portions 580, 630 form an X-shaped shielding divider structure 480 (FIG. 6) and defining, with walls 562*a*, 562*b*, 610 and 520, four fullyenclosed wire-receiving passageways 420 in the four quadrants around the X-shaped divider structure 480.

Elbow parts 540, 550 are each made from an electrically conductive material or a non-conductive material with a conductive coating or plating, such as aluminum alloy with electroless nickel plating, for example. Other suitable materials, such as gold or silver, can be used to plate elbow parts 540, 550, and other suitable materials, such as steel, copper or other suitable electrically conductive material, can be used to form elbow parts 540, 550. Each of elbow parts 540, 550 may be CNC machined from a monolithic piece of metal. In other embodiments, elbow parts 540, 550 are made from an insulating material, such as molded polyetherimide or other suitable thermoplastic resin, that is coated or plated with an electrically conductive material, such as silver, gold, or nickel.

In still other embodiments, rear shell 250 (FIG. 6) may be machined or otherwise formed from a single monolithic block of conductive metal or insulating material, without an interlocking assembly of elbow parts 540, 550. Other possible methods of integrally forming rear shell 250 in a monolithic structure include molding, casting, and metal injection molding (MIM), for example.

The projecting portion of X-shaped shielding divider 480 extends beyond rear end 410 and through X-shaped slot 462 in insulator subassembly 260 to provide shielding for contacts 30 all the way to PCB 24. In some embodiments, the PCB 24 may itself be machined with slots therethrough in generally the same X-shaped configuration as the X-shaped slot 462 of insulator subassembly 260, which slots in PCB 24 are plated with a conductive material to provide further shielding through the PCB 24 itself. In still other embodiments, the projecting portion of X-shaped divider 480 extending from rear end 410 of rear shell 250 may extend beyond insulator subassembly into an X-shaped plated slot in PCB 24, making electrical grounding contact with the plated slot in PCB.

In yet other embodiments, the projecting portion of X-shaped divider 480 may extend through and beyond such an X-shaped slot in PCB 24 and even beyond the distal ends of contacts 30, so as to provide shielding beyond the ends of contacts 30. A shielding cap made of a conductive material (including an insulating material with a conductive plating) may be positioned over a distal end of such an X-shaped divider 480, and attached to a bottom side of PCB 24 opposite face 40 to further enhance shielding between adjacent pairs of contacts 30. Such a cap should preferably be dimensioned to contact the distal end of X-shaped divider 480 and attach to a grounding pad on the surface of PCB 24, while not touching contacts 30.

It will be obvious to those having skill in the art that many changes may be made to the details of the above-described embodiments without departing from the underlying principles of the invention. The scope of the present invention should, therefore, be determined only by the following claims.

The invention claimed is:

1. A board-mount electrical connector, comprising:

a front body supporting a plurality of electrical contacts in spaced-apart alignment with a coupling axis along which a mating electrical connector is connectable to the board-mount electrical connector;

an insulator member supporting a plurality of board-mount contacts in spaced-apart relation and in alignment with a mounting axis of the electrical connector, each of the board-mount contacts being electrically connected to one of the electrical contacts; and an electrically conductive rear shell interposed between the insulator member and the front body, the rear shell including at least one electrically conductive shielding divider extending through the insulator member and positioned between two or more of the board-mount contacts.

2. The electrical connector of claim 1, wherein the shielding divider extends through the rear shell from a front end thereof adjacent the front body to an opposite rear end thereof proximate insulator member and the board-mount contacts, the shielding divider extending across an interior region of the rear shell to define multiple wire-receiving passageways that extend through the rear shell between the front and rear ends of the rear shell.

3. The electrical connector of claim 2, further comprising a plurality of wires extending through the passageways, a first end of each of the wires connected to one of the electrical contacts and a second end of each of the wires connected to one of the board-mount contacts.

4. The electrical connector of claim 2, wherein the shielding divider is X-shaped so as to form four passageways through the rear shell.

5. The electrical connector of claim 2, wherein the rear shell includes an elbow such that the mounting axis and the coupling axis are angularly disposed, and the passageways and shielding divider extend through the elbow of the rear shell.

6. The electrical connector of claim 1, wherein the front body is electrically conductive and includes multiple cavities extending in an axial direction along the coupling axis entirely through the front body, each of the cavities having a front opening at a front end of the front body and a rear opening at a rear end of the front body;

the rear shell is mated to the front body to provide electrical contact therebetween; and further comprising multiple electrically insulating sheaths retaining the electrical contacts in spaced apart relation, the sheaths sized for insertion in the cavities so as to align the electrical contacts with the front openings in the front body, and to prevent the electrical contacts from contacting each other or the front body.

7. The electrical connector of claim 6, wherein the rear shell abuts a rear end of the insulating sheaths and urges the insulating sheaths toward a front end of the front body.

8. The electrical connector of claim 1, wherein the rear shell and front body include interengaging tabs and notches to prevent rotation of the front body relative to the rear shell.

9. The electrical connector of claim 1, wherein the shielding divider is X-shaped and the insulator member includes an X-shaped slot that receives the X-shaped shielding divider.

10. The electrical connector of claim 1, wherein the rear shell has a rear end opposite the front body, the rear end defining a recess and the shielding divider extending into the recess, and the insulator member is seated in the recess.

11. The electrical connector of claim 1, wherein the insulator member includes a plurality of generally cylindrical electrically isolated contact-receiving spaces extending therethrough, the board-mount contacts seated in the contact-receiving spaces.

12. The electrical connector of claim 1, wherein the shielding divider extends beyond the insulator member.

13. The electrical connector of claim 1, wherein the shielding divider extends beyond distal ends of the board-mount contacts.

14. The electrical connector of claim 1, wherein the insulator member is formed by injecting a resin within an interior region of the rear shell and around a portion of the board-mount contacts.

15. The electrical connector of claim 1, wherein each of the board-mount contacts includes an outwardly projecting shoulder portion;

the insulator member includes an inner insulator plate having openings formed therein, and an outer insulator plate defining contact apertures that are aligned with the openings in the inner insulator plate, and the inner and outer insulator plates are joined together to capture the shoulder portions of the board-mount contacts between the inner and outer insulator plates and prevent the board-mount contacts from moving along the mounting axis relative to the inner and outer insulator plates.

* * * * *